US008179348B2

(12) United States Patent
Iisaka et al.

(10) Patent No.: US 8,179,348 B2
(45) Date of Patent: May 15, 2012

(54) DRIVING METHOD, DRIVING CIRCUIT, ELECTRO-OPTICAL DEVICE, AND ELECTRONIC APPARATUS

(75) Inventors: Hidehito Iisaka, Shiojiri (JP); Hiroyuki Hosaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 652 days.

(21) Appl. No.: 12/188,722

(22) Filed: Aug. 8, 2008

(65) Prior Publication Data

US 2009/0079769 A1 Mar. 26, 2009

(30) Foreign Application Priority Data

Sep. 25, 2007 (JP) ..... 2007-246688

(51) Int. Cl.
*G09G 3/36* (2006.01)

(52) U.S. Cl. ..... 345/89; 345/102; 345/691

(58) Field of Classification Search ..... 345/87–104, 345/690–699, 204–213
See application file for complete search history.

(56) References Cited

U.S. PATENT DOCUMENTS

| | | | | |
|---|---|---|---|---|
| 6,540,938 | B1 * | 4/2003 | Afzali-Arkadani et al. | 252/299.01 |
| 6,992,650 | B2 * | 1/2006 | Takei | 345/89 |
| 7,403,183 | B2 * | 7/2008 | Someya | 345/98 |
| 2002/0044116 | A1 * | 4/2002 | Tagawa et al. | 345/87 |
| 2003/0098836 | A1 * | 5/2003 | Takei | 345/87 |
| 2005/0140623 | A1 * | 6/2005 | Yoo | 345/88 |
| 2006/0097981 | A1 * | 5/2006 | Park et al. | 345/102 |
| 2007/0003709 | A1 * | 1/2007 | Mochizuki et al. | 428/1.2 |
| 2007/0236444 | A1 * | 10/2007 | Woo et al. | 345/102 |
| 2008/0231571 | A1 * | 9/2008 | Krijn et al. | 345/87 |

FOREIGN PATENT DOCUMENTS

JP A 11-237606 8/1999

* cited by examiner

*Primary Examiner* — Amare Mengistu
*Assistant Examiner* — Dmitriy Bolotin
(74) *Attorney, Agent, or Firm* — Oliff & Berridge, PLC

(57) ABSTRACT

A display device includes a data converting section that converts display data that is to be supplied to pixel units. The data converting section converting on the basis of a predetermined conversion rule for each of a plurality of fields. The plurality of fields corresponds to respective light emission time periods of the plurality of light beams and following one after another in a successive manner on a time axis. The predetermined conversion rule converts data for a preceding field of one color to achieve a value in a successive field of a different color, such that the value approaches a desired value for at least one of brightness and color obtained when an image is displayed in the display area during the successive field.

17 Claims, 7 Drawing Sheets

FIG. 4A

| DISPLAY COLOR | R | Y | ..... | B |
|---|---|---|---|---|
| PANEL TRANSMISSION FACTOR | 255 | 255 | ..... | 0 |

FIG. 4B

| DISPLAY COLOR | R | Y | ..... | B |
|---|---|---|---|---|
| PANEL TRANSMISSION FACTOR | 0 | 210 | ..... | 10 |

FIG. 4C

| DISPLAY COLOR | R | Y | ..... | B |
|---|---|---|---|---|
| PANEL TRANSMISSION FACTOR | 10 | 70 | ..... | 255 |

DRIVING METHOD, DRIVING CIRCUIT, ELECTRO-OPTICAL DEVICE, AND ELECTRONIC APPARATUS

BACKGROUND

1. Technical Field

The present invention relates to a method for driving various kinds of display devices and a circuit for driving various kinds of display devices. In addition, the present invention relates to an electro-optical device that uses such a driving method or is provided with such a driving circuit and further relates to an electronic apparatus that is provided with such an electro-optical device. An example of a variety of display devices to which the invention is directed is a liquid crystal display device, though not limited thereto. A non-limiting example of a variety of electronic apparatuses to which the invention is directed is a liquid crystal projector.

2. Related Art

In the technical field to which the present invention pertains, a field-sequential driving scheme has been proposed so far as one known method for driving various kinds of display devices such as a liquid crystal display device or the like. In a typical field-sequential drive operation, a backlight (e.g., backlight illumination device) emits red light, green light, and blue light in a periodic manner so as to display images in full color (i.e., full-color display). In such a periodic light-emission operation, the backlight emits light for each color (e.g., color tone or hue) independently of others. For this reason, such a typical field-sequential display is susceptible to color mixture. In an effort to provide a technical solution to such a color-mixture image problem, a method for effectively preventing or reducing the occurrence of color mixture has been proposed in the related art.

As one example thereof, JP-A-11-237606 discloses a technique for realizing uniform luminance distribution on the display screen of a liquid crystal panel at the start of writing operation, which is achieved by providing a reset time interval.

However, if the related-art technique described in JP-A-11-237606 is adopted, it is necessary to display black on the screen during the reset time interval, resulting in the prolonged liquid-crystal response time during the subsequent driving operation of liquid crystal, which follows the reset time interval. For this reason, as one specific example of technical disadvantages thereof, the responding state/behavior of the liquid crystal is not at a sufficiently transmissive level during the light emission time period of the backlight. As a result thereof, the brightness/luminance level of actual display is unsatisfactorily low.

SUMMARY

An advantage of some aspects of the invention is to provide a method for driving various kinds of display devices such as a liquid crystal device, though not limited thereto, which makes it possible for the display device to display images with high brightness and to represent correct color. In addition, the invention provides, as an advantage of some aspects thereof, a circuit for driving a variety of display devices that makes it possible for the display device to display images with high brightness and to represent correct color. Moreover, the invention provides, as an advantage of some aspects thereof, an electro-optical device that uses such a driving method or is provided with such a driving circuit. Furthermore, the invention provides, as an advantage of some aspects thereof, an electronic apparatus that is provided with such an electro-optical device. Note that the term "brightness" used in this paragraph as well as in the recitation of appended claims includes the meaning of "luminance" without any limitation thereto.

In order to address the above-identified problem without any limitation thereto, the invention provides, as a first aspect thereof, a method for driving a display device that includes: irradiating a plurality of light beams toward a display area in a time-divided manner, each of the plurality of light beams having an individual and/or own color that differs from those of others, the display area having a plurality of pixel units; converting display data that is to be supplied to the plurality of pixel units on the basis of at least one predetermined conversion rule for each of a plurality of fields, the plurality of fields being determined so as to correspond to respective light emission time periods of the plurality of light beams, the plurality of fields following one after another in a successive manner on a time axis, the predetermined conversion rule having been prepared so as to achieve an actual value that is close to a desired value for at least either one of brightness and color (hue) obtained when an image is displayed in the display area; and supplying the converted display data to the plurality of pixel units in a sequential manner for each of the plurality of fields.

In the method for driving a display device according to the first aspect of the invention described above, a plurality of light beams is emitted toward a display area in a time-divided manner. Each of the plurality of light beams has an individual and/or own color that differs from those of others. The display area has a plurality of pixel units. Herein, the term "pixel units" is used to encompass the meaning of pixel portions, pixel regions, pixel areas, or pixels, without any limitation thereto. That is, the plurality of light beams is irradiated toward the display area by means of a field-sequential driving scheme on an independent basis, that is, independently of one another. The irradiation of the plurality of light beams is performed in a frequency of, for example, 60 Hz or so (i.e., in a periodic manner). The plurality of light beams may be emitted from a plurality of light sources. For example, the plurality of light beams may be irradiated from a plurality of light-emitting diodes (LED) each of which has an individual and/or own color that differs from those of others. Or, alternatively, the plurality of light beams may be emitted from not plural light sources but a single light source. For example, the plurality of light beams may be emitted from a white light source that irradiates light having a plurality of color components. If a plurality of light sources is used, a (combined) light beam that changes its color at every moment of time enters each of the plurality of pixels of an electro-optical device as an incident projection light-source light beam or as an incident backlight beam. More specifically, each of the plurality of light beams that is irradiated from the plurality of light sources enters a color-combining optical unit such as a color-combination prism or the like. As a result thereof, as explained above, a "combined" light beam that changes its color at every moment of time propagates on the same single optical path to enter each of the plurality of pixels of an electro-optical device. On the other hand, if a single light source is used, a rotary color filter is provided on the optical path, although other alternative coloring (e.g., color-separating) scheme may be used. A light beam that is emitted from the single light source passes through the rotary color filter. As a result thereof, as explained above, a light beam that changes its color at every moment of time propagates on the single optical path to enter each of the plurality of pixels of an electro-optical device.

In the method for driving a display device according to the first aspect of the invention described above, display data that is to be supplied to the plurality of pixel units is converted for each of a plurality of fields. The "plurality of fields" is a set of time periods that are determined so as to correspond to the respective light emission time periods of the plurality of light beams. That is, each of the plurality of fields is associated with the light-emitting time period of the corresponding light beam. The plurality of fields follows one after another in a successive manner on a time axis. As a typical non-limiting example thereof, the plurality of fields is preset (i.e., predetermined) in such a manner that each of the plurality of fields is in synchronization with the light-emitting time period of the corresponding light beam. Or, as another non-limiting typical example thereof, the plurality of fields is preset in such a manner that each of the plurality of fields has a special/particular relation to the light-emitting time period of the corresponding light beam. Or, alternatively, the plurality of fields may not be predetermined but be determined in a variable manner on a real-time basis in accordance with the light emission time period or in accordance with the display data. That is, the plurality of fields may be variably set on a real-time basis as one parameter that is used to improve display quality.

Since display data is converted for each of the plurality of fields in the method for driving a display device according to the first aspect of the invention described above, it is possible to achieve adequate data conversion for the corresponding light emission time period. Or, in other words, because display data is converted for each of the plurality of fields in the driving method according to the first aspect of the invention described above, it is possible to achieve adequate data conversion for the corresponding color of a plurality of light beams (i.e., the corresponding one of a plurality of color tones or hues). It should be particularly noted that, in the driving method according to the first aspect of the invention described above as well as other aspects thereof, the effects of display-data conversion that is performed in each of the plurality of fields that is associated with the light-emitting time period of the corresponding light beam are not always limited to the brightness and color (hue) for the above-mentioned (one) light-emitting time period. That is, in the driving method according to the first aspect of the invention described above as well as other aspects thereof, display-data conversion that is performed in each of the plurality of fields that is associated with the light-emitting time period of the corresponding light beam could have effects on the brightness and color (hue) not only for the above-mentioned light-emitting time period but also for other light-emitting time periods corresponding to other fields such as the preceding field and the next field.

In the method for driving a display device according to the first aspect of the invention described above, data conversion is performed on the basis of at least one predetermined conversion rule. The "predetermined conversion rule" has been prepared either theoretically or empirically so as to achieve an actual value that is close to a desired value for at least either one of brightness and color (hue) obtained when an image is displayed in the display area. That is, display data is converted in such a manner that actual brightness and/or color approximates desired brightness and/or color. Such data conversion can be performed, typically, by means of a conversion table that is prepared on the basis of a conversion rule for each field.

After the data conversion, the display data is supplied to the plurality of pixel units for each of the plurality of fields, and thus in a field-sequential manner. That is, the converted display data is supplied to the plurality of pixel units at timing corresponding to the light emission time periods of the plurality of light beams. Therefore, it is possible to display images having actual brightness and/or color close to desired brightness and/or color at the display area of a display device.

As explained above, in the method for driving a display device according to the first aspect of the invention, display data is converted for each of a plurality of fields; and therefore, it is possible to display images having actual brightness and/or color close to desired brightness and/or color at the display area of a display device.

It is preferable that the method for driving a display device according to the first aspect of the invention described above should further include: setting the plurality of fields in such a manner that the plurality of fields correspond to the respective light emission time periods of the plurality of light beams and that the plurality of fields follow one after another in a successive manner on a time axis, wherein the above-mentioned conversion of the display data is performed so as to convert the display data for each of the plurality of set fields.

In the preferred method for driving a display device according to the first aspect of the invention described above, the plurality of fields is set in such a manner that they (i.e., the plurality of fields) correspond to the respective light emission time periods of the plurality of light beams and further that they (i.e., the plurality of fields) follow one after another in a successive manner on a time axis That is, the length of a time period of each of the plurality of fields and/or the starting point in time thereof (and/or other similar time-related factor(s)) is set in association with the corresponding one of the light emission time periods of the plurality of light beams. Therefore, it is possible to convert the display data for each of the plurality of fields and then supply the converted data to the pixel units in a field-sequential manner. Therefore, it is possible to display, with increased reliability, images having actual brightness and/or color close to desired brightness and/or color at the display area of a display device.

It is preferable that the method for driving a display device according to the first aspect of the invention described above should further include: setting the plurality of fields in accordance with the display data so as to achieve an actual value that is close to a desired value for at least either one of brightness and color obtained when an image is displayed in the display area, wherein the above-mentioned conversion of the display data is performed so as to convert the display data for each of the plurality of set fields.

In the preferred method for driving a display device according to the first aspect of the invention described above, the plurality of fields is set in accordance with the display data so as to achieve an actual value that is close to a desired value for at least either one of brightness and color obtained when an image is displayed in the display area. That is, the plurality of fields is set in accordance with the display data so that data conversion can be performed for each of the plurality of fields in a more desirable manner. As a typical operation thereof, either the length of a time period of each of the plurality of fields or the starting point in time thereof is variably set on a real time basis, which is dependent on the display data. By this means, it is possible to perform the conversion of the display data in a more desirable manner. Therefore, it is possible to display images having actual brightness and/or color further closer to desired brightness and/or color at the display area of a display device.

In the method for driving a display device according to the first aspect of the invention described above, it is preferable that the plurality of pixel units should contain, without any limitation thereto, liquid crystal; and the plurality of fields should be determined on the basis of the response time of the liquid crystal.

In the preferred method for driving a display device according to the first aspect of the invention described above, the plurality of pixel units contains, without any limitation thereto, liquid crystal. In a case where the pixel units contain liquid crystal, it takes some time from a point in time at which display data is supplied to the pixel units to a point in time at which an image is displayed (i.e., display becomes available) on the basis of the supplied display data. That is, liquid crystal requires some time for transition into an image-display state. In the description of this specification as well as in the recitation of appended claim, the liquid crystal state transition time period from the supplying of display data to the displaying of an image is referred to as the "response time" thereof.

In the preferred method for driving a display device according to the first aspect of the invention described above, the plurality of fields is determined on the basis of the response time of the liquid crystal. That is, the length of a time period of each of the plurality of fields and/or the starting point in time thereof (and/or other similar time-related factor(s)) differs/changes depending on the response time of the liquid crystal. Therefore, it is possible to convert the display data and supply the converted display data on the basis of the response time of the liquid crystal. Note that the response time of the liquid crystal is unique to each individual display device. That is, the response time of the liquid crystal is a known value as long as the display device is known. Therefore, it is possible to preset the plurality of fields (e.g., the length of a time period of each of the plurality of fields and/or the starting point in time thereof) on the basis thereof.

Since it is possible to convert the display data and to supply the converted display data on the basis of (i.e., in accordance with) the response time of the liquid crystal, it is further possible to avoid low brightness because of the delayed response of the liquid crystal. In addition, because it is possible to convert the display data and to supply the converted display data in accordance with (i.e., on the basis of) the response time of the liquid crystal, it is further possible to avoid failure in representing a correct color (e.g., color tone or hue). Therefore, it is possible to display, in a more preferable manner, images having actual brightness and/or color close to desired brightness and/or color at the display area of a display device.

In the method for driving a display device according to the first aspect of the invention described above, it is preferable that the plurality of pixel units should contain, without any limitation thereto, liquid crystal; and the conversion rule should be set on the basis of the response time of the liquid crystal.

In the preferred method for driving a display device according to the first aspect of the invention described above, the plurality of pixel units contains, without any limitation thereto, liquid crystal. Therefore, as has already been explained above, it takes some time from a point in time at which display data is supplied to the pixel units to a point in time at which an image is displayed on the basis of the supplied display data. That is, liquid crystal requires the above-defined response time for transition into an image-display state.

In the preferred method for driving a display device according to the first aspect of the invention described above, the conversion rule is set on the basis of the response time of the liquid crystal. That is, the conversion rule is set in accordance with the response time of the liquid crystal so as to realize more preferable data conversion. Since it is possible to convert the display data on the basis of (i.e., in accordance with) the response time of the liquid crystal, it is further possible to avoid low brightness because of the delayed response of the liquid crystal. In addition, because it is possible to convert the display data in accordance with (i.e., on the basis of) the response time of the liquid crystal, it is further possible to avoid failure in representing a correct color. Therefore, it is possible to display, in a more preferable manner, images having actual brightness and/or color close to desired brightness and/or color at the display area of a display device.

In the method for driving a display device according to the first aspect of the invention described above, it is preferable that the plurality of pixel units should contain, without any limitation thereto, liquid crystal; and the liquid crystal should be twisted nematic liquid crystal.

In the preferred method for driving a display device according to the first aspect of the invention described above, the pixel units of the display area contain, without any limitation thereto, twisted nematic liquid crystal, which may be hereafter referred to as "TN liquid crystal". Generally speaking, the response time of TN liquid crystal is longer than that of VA (Vertical Alignment) liquid crystal or IPS (In-Place Switching, or In-Plane Switching) liquid crystal, though not limited thereto.

As explained above, in the preferred method for driving a display device according to the first aspect of the invention, display data is converted for each of a plurality of fields; and therefore, it is possible to display images having actual brightness and/or color close to desired brightness and/or color at the display area of a display device. More specifically, it is possible to avoid low brightness because of the delayed response of the liquid crystal. In addition, it is further possible to avoid failure in representing a correct color. The advantageous effects of the method for driving a display device according to the first aspect of the invention described above are more remarkable if the response time of the liquid crystal is longer.

In this respect, in the preferred method for driving a display device according to the first aspect of the invention described above, the pixel units of the display area contain, without any limitation thereto, the TN liquid crystal, which means that the liquid crystal response time thereof is relatively long. Therefore, the advantageous effects of the preferred method for driving a display device according to the first aspect of the invention described above are more remarkable because the response time of the TN liquid crystal is relatively long. That is, the preferred method for driving a display device according to the first aspect of the invention described above makes it possible to display images having actual brightness and/or color close to desired brightness and/or color at the display area of a display device with more remarkable effects.

In a case where a driving frequency is heightened by means of the VA liquid crystal or by means of the IPS liquid crystal, the response of the liquid crystal is relatively slow even with the use of such liquid crystal. Therefore, the preferred method for driving a display device according to the first aspect of the invention described above produces very advantageous effects.

In the method for driving a display device according to the first aspect of the invention described above, it is preferable that the plurality of fields should be determined depending on the respective positions of the pixel units of (i.e., in) the display area.

In the preferred method for driving a display device according to the first aspect of the invention described above, the plurality of fields is determined depending on the respective positions of the pixel units of the display area. Therefore, the length of a time period of each of the plurality of fields and/or the starting point in time thereof differs/changes depending on the respective positions of the pixel units of the display area. Herein, it should be noted that the meaning of "the respective positions of the pixel units" is not limited to the respective positions of the pixels (i.e., single pixel). For example, "the respective positions of the pixel units" encompasses the meaning of the respective positions of pixel blocks each of which is made up of a plurality of pixels. Or, as another non-limiting example, "the respective positions of the pixel units" may be the respective positions of pixel rows each of which is made up of a plurality of pixels or the respective positions of pixel columns each of which is made up of a plurality of pixels. Regardless of whether the field is determined depending on the position of a single pixel, a pixel block that is made up of a plurality of pixels, a pixel row that is made up of a plurality of pixels, or a pixel column that is made up of a plurality of pixels, the length of a time period of each of the plurality of fields and/or the starting point in time thereof that is suitable for the corresponding position of the pixel unit is a known value as long as the display device is known. Therefore, it is possible to preset the plurality of fields (e.g., the length of a time period of each of the plurality of fields and/or the starting point in time thereof) on the basis thereof. As a typical non-limiting example of field determination, the length of a time period of each of the plurality of fields and/or the starting point in time thereof corresponds to the sequential order of scanning operation that is performed in a display area. For example, in a case where display data is supplied through vertical-scan operation, the lengths of time periods of the plurality of fields and/or the starting points in time thereof differ/vary from one another depending on respective vertical positions on the display area.

In the preferred method for driving a display device according to the first aspect of the invention described above, the plurality of fields is determined depending on the respective positions of the pixel units of the display area as has already been explained above. Therefore, for example, in a case where the pixel units are subjected to sequential scanning operation for image display, it is possible to perform such data conversion that makes it possible to correct a shift in the timing of display-data supply that is attributable to a difference in the respective positions of the pixel units of the display area. Therefore, it is possible to display, in a more preferable manner, images having actual brightness and/or color close to desired brightness and/or color at the display area of a display device.

In the method for driving a display device according to the first aspect of the invention described above, it is preferable that the conversion rules should be set depending on the respective positions of the pixel units of (i.e., in) the display area.

In the preferred method for driving a display device according to the first aspect of the invention described above, since the conversion rules are set depending on the respective positions of the pixel units of the display area, display data is converted by means of, that is, on the basis of different (sets of) conversion rules that depend on the respective positions of the pixel units of the display area. In the preferred method for driving a display device according to the first aspect of the invention described above, the conversion rules are set depending on the respective positions of the pixel units of the display area as has already been explained above. Therefore, for example, in a case where the pixel units are subjected to sequential scanning operation for image display, it is possible to perform such data conversion that makes it possible to correct a shift in the timing of display-data supply that is attributable to a difference in the respective positions of the pixel units of the display area. Therefore, it is possible to display, in a more preferable manner, images having actual brightness and/or color close to desired brightness and/or color at the display area of a display device.

In the method for driving a display device according to the first aspect of the invention described above, it is preferable that each of the light emission time periods of the plurality of light beams should be shorter than the corresponding one of the plurality of fields.

In the preferred method for driving a display device according to the first aspect of the invention described above, each of the light-emitting time periods of the plurality of light beams is shorter than the corresponding one of the plurality of fields, which means that each of the plurality of fields has a non-light-emitting time period other than the corresponding light-emitting time period. No light is irradiated during the non-light-emitting time period. As a typical non-limiting example of field determination, the ending position (e.g., ending point in time, though not limited thereto) of each light emission time period is synchronized with the ending position (e.g., ending point in time, though not limited thereto) of the corresponding field.

The display contribution ratio of each non-light-emitting time period, which is the percentage of contribution to image display attributable to each non-irradiation time period, is relatively small in comparison with that of the corresponding light-emitting time period. That is, the contribution of each non-light-emitting time period to the brightness of a display image or the color thereof is comparatively small percentage-wise. Or, in other words, overall display performance will be high as long as transmission performance during each light-emitting time period is high regardless of whether transmission performance during each non-light-emitting time period is high or not. Therefore, for example, in a case where the pixel units contain liquid crystal, it is possible to put the liquid crystal in a fully responsive state prior to the start of the target light-emission time period if the liquid crystal is "pre-driven" during other time period. Therefore, it is possible to display, in a more preferable manner, images having actual brightness and/or color close to desired brightness and/or color at the display area of a display device.

As explained above, in the preferred method for driving a display device according to the first aspect of the invention, each of the light-emitting time periods of the plurality of light beams is shorter than the corresponding one of the plurality of fields, which means that each of the plurality of fields has a non-light-emitting time period other than the corresponding light-emitting time period; and therefore, it is possible to display, in a more preferable manner, images having actual brightness and/or color close to desired brightness and/or color at the display area of a display device.

It is preferable that the method for driving a display device according to the first aspect of the invention described above should further include: temporarily storing the converted display data, wherein the above-mentioned supplying of the converted display data is performed (i.e., the converted display data is supplied) in such a manner that the temporarily stored display data is read out and then supplied to the pixel units in a sequential manner.

In the preferred method for driving a display device according to the first aspect of the invention described above, the display data that has been subjected to conversion on the basis of the predetermined conversion rule is temporarily stored. That is, the converted display data is temporarily stored into a memory device such as a frame buffer memory without any limitation thereto. Thereafter, the display data is read out of the memory and then send to the pixel units. The frame buffer memory can store the display data for each single frame or each set of plural frames. Note that it is not necessary for all of the converted display data to be stored into the memory. That is, some of the converted display data may be directly supplied to the pixel units without being temporarily stored into the memory whereas other converted display data is temporarily stored into the memory.

In the preferred method for driving a display device according to the first aspect of the invention described above, the converted display data is temporarily stored into the memory; and therefore, it is possible to supply the readout display data to the pixel units in a sequential manner at timing corresponding to, for example, the respective light emission time periods of the plurality of light beams. That is, it is possible to supply the display data to the pixel units at a desired timing. Therefore, it is possible to display, in a more preferable manner, images having actual brightness and/or color close to desired brightness and/or color at the display area of a display device.

In order to address the above-identified problem without any limitation thereto, the invention provides, as a second aspect thereof, a circuit for driving a display device, the driving circuit including: a light irradiating section that emits a plurality of light beams toward a display area in a time-divided manner, each of the plurality of light beams having an individual and/or own color that differs from those of others, the display area having a plurality of pixel units; a data converting section that converts display data that is to be supplied to the plurality of pixel units on the basis of at least one predetermined conversion rule for each of a plurality of fields, the plurality of fields being determined so as to correspond to respective light emission time periods of the plurality of light beams, the plurality of fields following one after another in a successive manner on a time axis, the predetermined conversion rule having been prepared so as to achieve an actual value that is close to a desired value for at least either one of brightness and color obtained when an image is displayed in the display area; and a data supplying section that supplies the converted display data to the plurality of pixel units in a sequential manner for each of the plurality of fields.

With such a configuration of a circuit for driving a display device according to the second aspect of the invention, it is possible to produce the same advantageous effects as those offered by the method for driving a display device according to the first aspect of the invention explained above. That is, in the configuration of a driving circuit according to the second aspect of the invention described above, display data is converted for each of a plurality of fields; and therefore, it is possible to display images having actual brightness and/or color close to desired brightness and/or color at the display area of a display device.

Any of the preferred modes of the invention described above, which add restrictive features to the fundamental features of the driving method according to the first aspect of the invention, may be applied to the driving circuit according to the second aspect of the invention. If so applied, the driving circuit according to the second aspect of the invention that features any of the preferred modes of the invention offers the same operation/working effects as those of the preferred method for driving a display device according to the first aspect of the invention explained above.

In order to address the above-identified problem without any limitation thereto, the invention provides, as a third aspect thereof, an electro-optical device that is provided with the circuit for driving a display device according to the second aspect of the invention.

Since an electro-optical device according to the third aspect of the invention is provided with the circuit for driving a display device according to the second aspect of the invention described above, it is possible to display images having actual brightness and/or color close to desired brightness and/or color at the display area of a display device.

In order to address the above-identified problem without any limitation thereto, the invention provides, as a fourth aspect thereof, an electronic apparatus that is provided with the electro-optical device according to the third aspect of the invention.

According to an electronic apparatus of this aspect of the invention, it is possible to embody various kinds of electronic devices that are capable of displaying images having actual brightness and/or color close to desired brightness and/or color at the display area of a display device, including but not limited to, a projection-type display device, a television, a mobile phone, an electronic personal organizer, a word processor, a viewfinder-type video tape recorder, a direct-monitor-view-type video tape recorder, a workstation, a videophone, a POS terminal, a touch-panel device, and so forth, because the electronic apparatus of this aspect of the invention is provided with the electro-optical device according to the above-described aspect of the invention. In addition, as another non-limiting application example thereof, an electronic apparatus of this aspect of the invention may be also embodied as an electrophoresis apparatus such as a sheet of electronic paper.

These and other features, operations, and advantages of the present invention will be fully understood by referring to the following detailed description of exemplary embodiments in conjunction with the accompanying drawings.

BRIEF DESCRIPTION OF THE DRAWINGS

The invention will be described with reference to the accompanying drawings, wherein like numbers reference like elements.

FIGS. 4A, 4B, and 4C is a set of diagrams that schematically illustrates an example of a conversion table, which is used by a conversion unit according to an exemplary embodiment of the invention.

DESCRIPTION OF EXEMPLARY EMBODIMENTS

With reference to the accompanying drawings, exemplary embodiments of the present invention are described below.

Driving Method and Driving Circuit

In the following description, a method/circuit for driving a display device according to an exemplary embodiment of the invention is explained while referring to FIGS. 1-8. It should be noted that the phrase "a circuit for driving a display device" that appears in the following description of this specification as well as in the recitation of appended claims encompasses the meaning of, in addition to its literal meaning, "a driving circuit of a display device" without any limitation thereto. In the following description, a method for driving a display device according to an exemplary embodiment of the invention may be simply referred to as "driving method". In like manner, a circuit for driving a display device according to an exemplary embodiment of the invention may be simply referred to as "driving circuit". In the following description of exemplary embodiments of the invention, a liquid crystal device that is provided with a liquid crystal panel is taken as a non-limiting example of a "display device", which is the target of driving operation.

Figure 1:
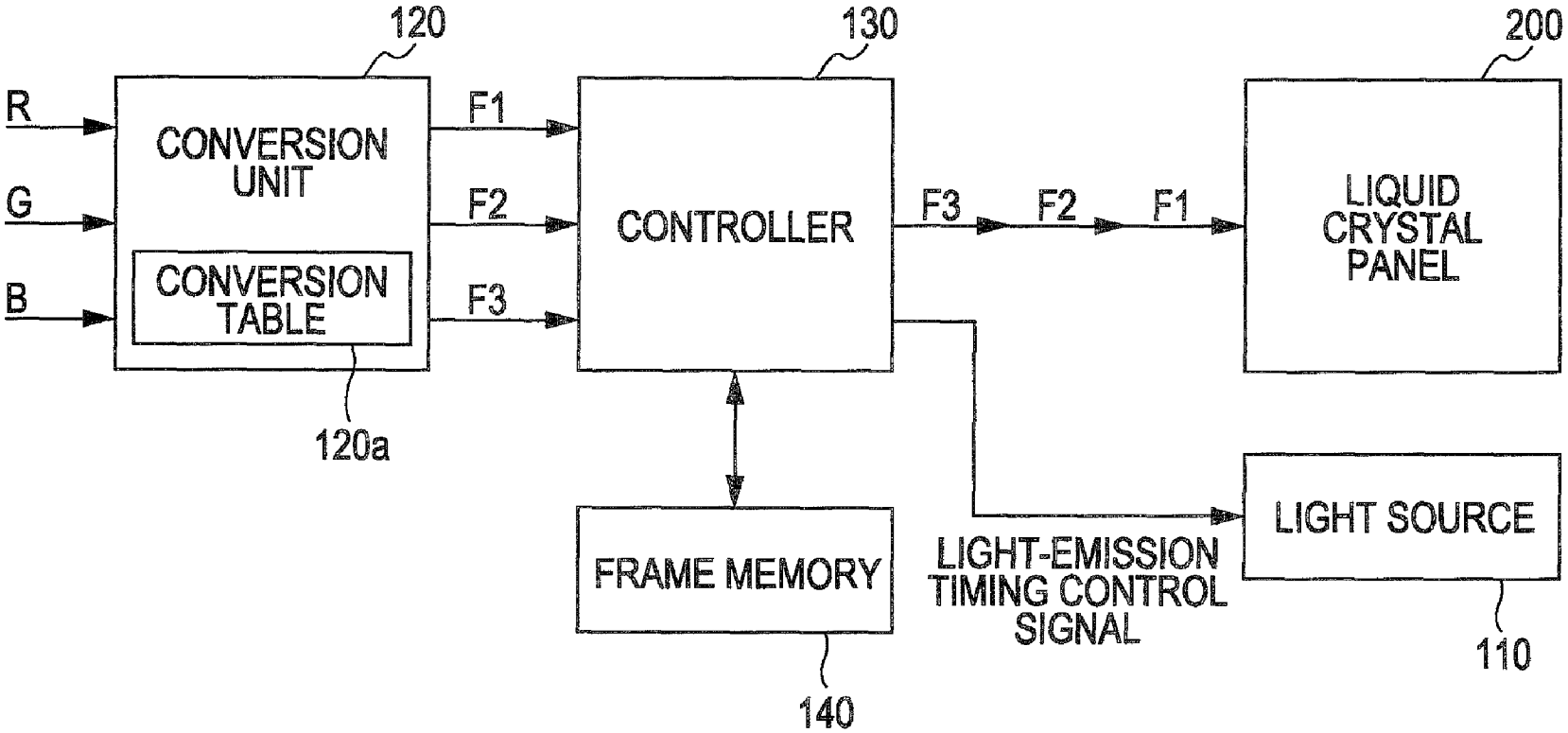
FIG. 1 is a block diagram that schematically illustrates an example of the configuration of a driving circuit according to an exemplary embodiment of the invention.

First of all, an example of the configuration of a driving circuit according to an exemplary embodiment of the invention is explained with reference to FIG. 1. FIG. 1 is a block diagram that schematically illustrates an example of the configuration of a driving circuit according to an exemplary embodiment of the invention.

As illustrated in FIG. 1, a driving circuit according to the present embodiment of the invention is provided with a light source 110, a conversion unit 120, a controller 130, and a frame memory 140. The light source 110 is a non-limiting example of a "light irradiating section" according to an aspect of the invention. The conversion unit 120 is a non-limiting example of a "data converting section" according to an aspect of the invention. The controller 130 is a non-limiting example of a "data supplying section" according to an aspect of the invention.

The light source is made up of, for example, a plurality of light-emitting diodes (LED). The plurality of light-emitting diodes emits light corresponding to three primary color components, that is, red (R), green (G), and blue (B). Each of the plurality of light-emitting diodes emits light of the corresponding primary color component at a periodic interval in such a manner that their light-emitting time periods do not overlap one another. Thus, there occurs no time conflict during the light-emitting operation thereof. Each of red, green, and blue light emitted from the corresponding one of the plurality of light-emitting diodes enters a color-combining optical unit such as a color-combination prism or the like as an incident light beam. As a result of combination thereof, a "combined" light beam is emitted from the color-combining unit toward a liquid crystal panel 200 illustrated in FIG. 1. Notwithstanding the foregoing, however, a single light-emitting element may emit light corresponding to not a single color but plural colors (e.g., color tones or hues) that differ from each other or one another.

The conversion unit 120 is provided with an arithmetic circuit and a memory circuit/device, though not limited thereto. Having such data-converting circuitry, the conversion unit 120 converts input display data (i.e., "to-be-displayed" data), which corresponds to each of three primary color components of R, G, and B, on the basis of a predetermined conversion rule. Then, the conversion unit 120 outputs the converted display data to the controller 130. Specifically, in the configuration of a driving circuit according to the present embodiment of the invention, the conversion unit 120 has at least one conversion table 120*a*. The conversion table(s) 120*a* stored in the conversion unit 120 was prepared in accordance with a predetermined conversion rule(s).

The controller 130 is provided with, for example, a logical operation circuit such as a CPU (Central Processing Unit), without any limitation thereto. The controller 130 temporarily stores the converted display data that is supplied from the conversion unit 120 into the frame memory 140. Then, the controller 130 reads the stored display data out of the frame memory 140 in a sequential manner so as to supply the readout display data to the liquid crystal panel 200. While outputting the readout display data to the liquid crystal panel 200, the controller 130 outputs a light-emission timing control signal to the light source 110. In addition to the functional operation described above, the controller 130 may control the entire operation of a driving circuit according to the present embodiment of the invention. The controller 130 may further control the entire operation of a display device. In the foregoing description of an exemplary configuration of a driving circuit according to the present embodiment of the invention, the conversion unit 120 and the controller 130 are provided as discrete units, which are separated from each other. However, the scope of the invention is not limited to such an exemplary configuration. As a non-limiting modification example thereof, the controller 130 may include the conversion unit 120 so that the conversion unit 120 functions as an internal component unit of the controller 130.

Figure 2:
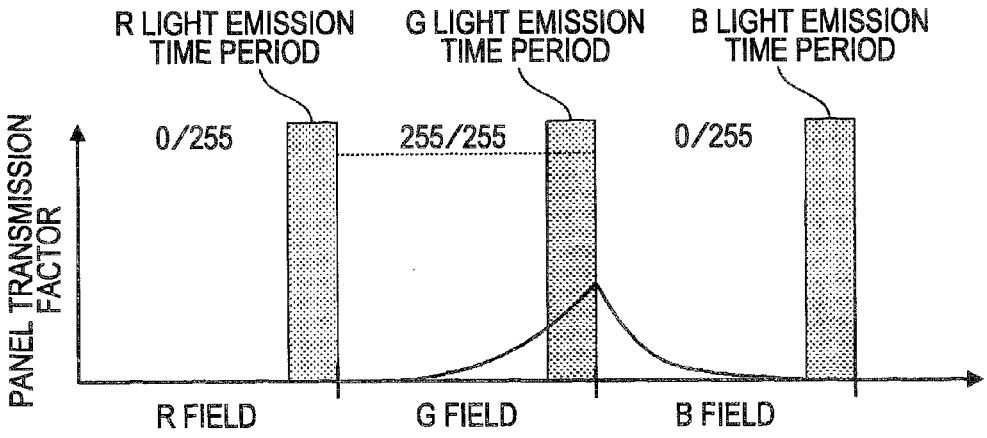
FIG. 2 is a graph that shows an example of liquid crystal control that is performed at the time when a green (G) color component is displayed, which is shown for the purpose of comparison (i.e., comparative example).
Figure 3:
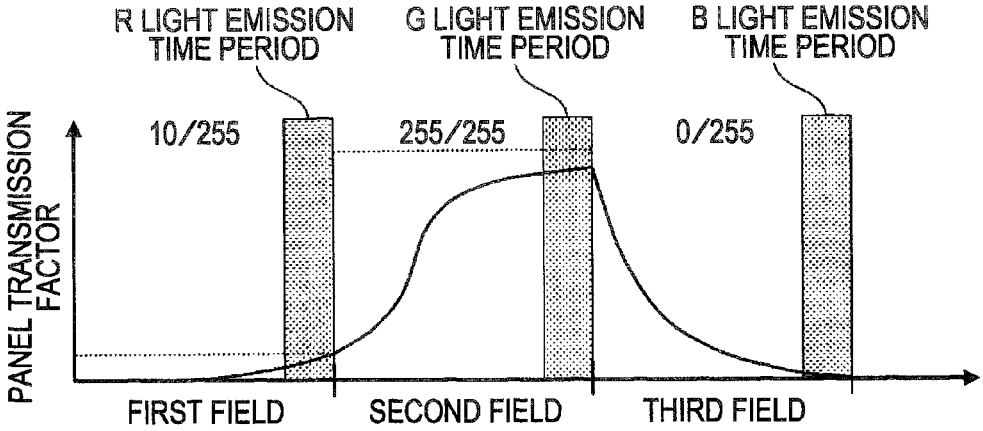
FIG. 3 is a graph that shows an example of liquid crystal control performed at the time of green display according to an exemplary embodiment of the invention.
Figure 5:
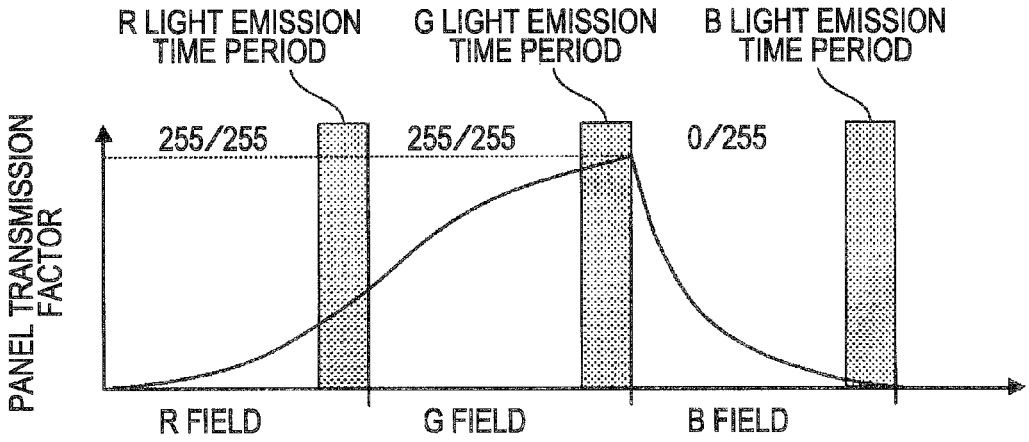
FIG. 5 is a graph that shows an example of liquid crystal control that is performed at the time of yellow (Y) display, which is shown for the purpose of comparison.
Figure 6:
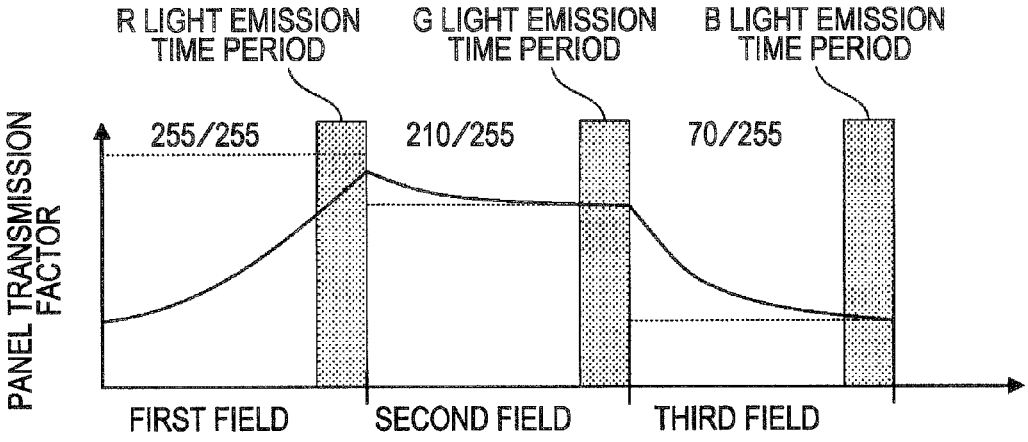
FIG. 6 is a graph that shows an example of liquid crystal control performed at the time of yellow display according to an exemplary embodiment of the invention.
Figure 7:
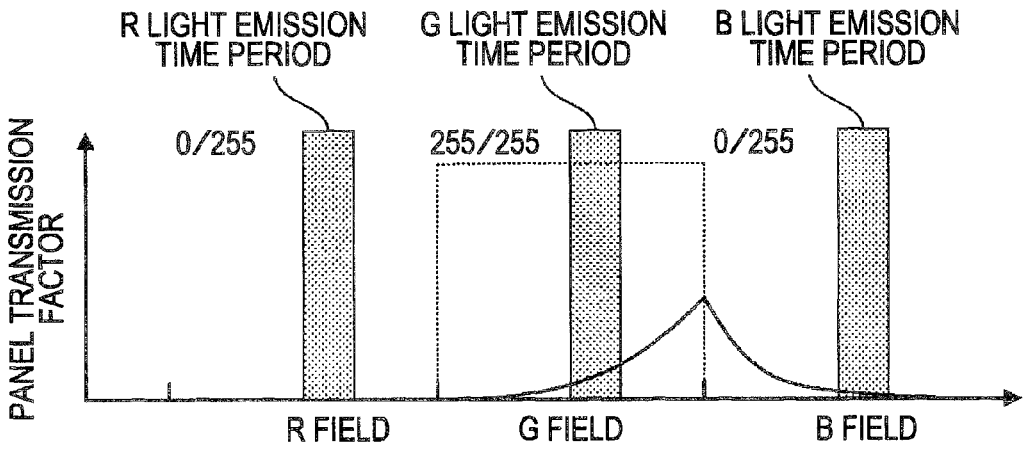
FIG. 7 is a graph that shows an example of liquid crystal control that is performed at a certain different position on a liquid crystal panel, which is shown for the purpose of comparison.
Figure 8:
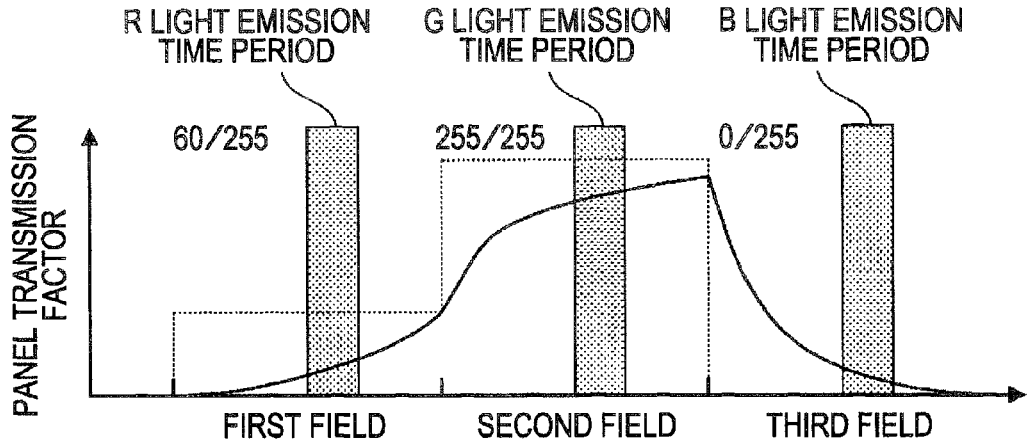
FIG. 8 is a graph that shows an example of liquid crystal control according to an exemplary embodiment of the invention, which corresponds to a comparative example of FIG. 7.

Next, a method for driving a display device according to an exemplary embodiment of the invention is explained while referring to FIGS. 2-8 as well as FIG. 1. FIG. 2 is a graph that shows an example of liquid crystal control that is performed at the time when a green (G) color component is displayed, which is shown for the purpose of comparison (i.e., comparative example). FIG. 3 is a graph that shows an example of liquid crystal control performed at the time of green display according to an exemplary embodiment of the invention. FIGS. 4A, 4B, and 4C is a set of diagrams that schematically illustrates an example of a conversion table, which is used by a conversion unit according to an exemplary embodiment of the invention. FIG. 5 is a graph that shows an example of liquid crystal control that is performed at the time of yellow (Y) display, which is shown for the purpose of comparison. FIG. 6 is a graph that shows an example of liquid crystal control performed at the time of yellow display according to an exemplary embodiment of the invention. FIG. 7 is a graph that shows an example of liquid crystal control that is performed at a certain different position on a liquid crystal panel, which is shown for the purpose of comparison. FIG. 8 is a graph that shows an example of liquid crystal control according to an exemplary embodiment of the invention, which corresponds to a comparative example of FIG. 7. In the following description, it is assumed that a driving circuit according to an exemplary embodiment of the invention, which has a circuit configuration explained above, performs a method for driving a display device according to an exemplary embodiment of the invention (i.e., a driving method according to an exemplary embodiment of the invention). The optical transmittance, that is, light transmission factor, of the liquid crystal panel 200 is controlled as a result of the supplying of display data thereto. In the following description, the light transmission factor of the liquid crystal panel 200 may be referred to as "panel transmission factor". The panel transmission factor is represented as a numerical value that ranges from 0 to 255.

In the comparative-example graph of FIG. 2, it is assumed that "mono-green" (which is an example of "non-intermediate" colors) display is performed. That is, in the assumed case where a green (G) color component only is displayed, the panel transmission factor is set at a value of 0 in the red (R) field, at a value of 255 in the green (G) field, and at a value of 0 in the blue (B) field. That is, as indicated by a chain line in the comparative-example graph of FIG. 2, liquid crystal is controlled in such a manner that the panel transmission factor is theoretically at the maximum value throughout the time period of the G field during which G light is emitted.

However, as shown by a solid line in the comparative-example graph of FIG. 2, the actual panel transmission factor is nowhere near the maximum value of 255 even if liquid crystal is controlled in such a manner that the panel transmission factor is theoretically at the maximum value from the start of the G field. This is because it takes some time for liquid crystal to respond. In such a case, liquid crystal fails to fully transmit G light. For this reason, the display brightness/luminance of the liquid crystal panel 200 is significantly decreased, which is undesirable.

FIG. 3 shows an example of liquid crystal control that is performed at the time of green display according to an exemplary embodiment of the invention. In a method for driving a display device according to an exemplary embodiment of the invention, input display data is converted at the conversion unit 120, which is illustrated in FIG. 1. The conversion unit 120 uses the conversion table 120*a* so as to convert the input display data. More specifically, the conversion unit 120 uses the conversion table 120*a* shown in FIG. 4A in order to convert data that is inputted into (i.e., sent to or received at) the conversion unit 120 as "to-be-displayed" data in the R field. The term "to-be-displayed" data means data that is to be displayed after processing or data that is subjected to processing for display. In the description of this specification as well as in the recitation of appended claims, to-be-displayed data is simply referred to as "display data". That is, the conversion unit 120 converts the incoming display data of the R field (i.e., display data that is sent thereto in the R field) into such data that specifies, for example, the panel transmission factor of "255" for displaying the red (R) color component on the liquid crystal panel 200 and the panel transmission factor of "0" for displaying the blue (B) color component on the liquid crystal panel 200 on the basis of the conversion table 120*a* shown in FIG. 4A. After being subjected to the conversion processing described above, the display data is outputted from the conversion unit 120 as data F1, which corresponds to a first field. The conversion unit 120 converts display data that is sent thereto in the G field on the basis of the conversion table shown in FIG. 4B. After the conversion processing, the conversion unit 120 outputs the converted data as data F2, which corresponds to a second field. In like manner, the conversion unit 120 converts display data that is sent thereto in the B field on the basis of the conversion table shown in FIG. 4C and then outputs the converted data as data F3, which corresponds to a third field. Assuming that each of three primary color components R, G, and B is expressed in two hundred and fifty-five gradation scales, the conversion table 120*a* has a product of 255×255×255. Notwithstanding the above, however, it can be simplified if any color tone that is not actually used and/or any redundant color tone that is similar to other color tone is omitted. The values set in the conversion table 120*a* can be, for example, predetermined as follows: actual display brightness/luminance in the display area of a display device and color tone thereof are monitored while data is supplied to the display device; the panel transmission factor for each field is adjusted so as to achieve desired brightness/luminance and color tone; the values set in the conversion table 120*a* are predetermined as a result of such visual observation and adjustment.

The number of the conversion table 120*a* may not be one. That is, if it is possible to represent (i.e., display) the same/similar color tone by means of a plurality of (sets of) conversion rules that differ from each other or one another, not a single but plural conversion tables 120*a* may be set so as to correspond to the plural (sets of) conversion rules. In such a case, the plural conversion tables 120*a* can be selectively used. The plurality of conversion tables may be set so as to correspond to more than one position on the liquid crystal panel 200. More detailed explanation thereof will be given later.

The conversion unit 120 converts the display data as explained above. As a result thereof, in the specific example of the present embodiment of the invention, the panel transmission factor for the first field is set at a value of 10. The panel transmission factor for the second field is set at a value of 255. The panel transmission factor for the third field is set at a value of 0. Although the first field according to an exemplary embodiment of the invention corresponds to the R field of the comparative example explained above, the technical property thereof differs from each other. In like manner, although the second and third fields according to an exemplary embodiment of the invention correspond to the G and B fields of the comparative example explained above, respectively, the technical nature thereof differs from each other. The R field of the comparative example is dedicated to the display of the red color component. The G and B fields of the comparative example are dedicated to the display of the green and blue color components, respectively. In contrast, each of the first, second, and third fields according to an exemplary embodiment of the invention is not dedicated to the display of only one of these three primary color components. That is, each of the first, second, and third fields according to an exemplary embodiment of the invention could contribute to the display of any one or more of R, G, and B. For example, the control of liquid crystal that is performed in the first field, which includes an R light emission time period (i.e., light-emitting time period), could contribute to the display of the green color component. The length of the time period of each field and/or the starting position (e.g., starting point in time, though not limited thereto) thereof may be determined (e.g., predetermined, without any limitation thereto) on the basis of, for example, the response time of liquid crystal or other alternative time-dependent factor(s). Or, alternatively, the length of the time period of each field and/or the starting position thereof may be variably determined on a real time basis, which is dependent on, for example, display data that is supplied thereto.

Referring back to FIG. 1, converted display data is sent from the conversion unit 120 to the controller 130. The controller 130 temporarily stores the received display data into the frame memory 140. Thereafter, the controller 130 reads the stored display data out of the frame memory 140 so as to supply the readout display data to the liquid crystal panel 200 in a field-sequential manner. At the liquid crystal panel 200, the aforementioned panel transmission factor is controlled for every field in accordance with the display data that is supplied from the controller 130. While the controller 130 supplies the display data to the liquid crystal panel 200, it sends a light-emission timing control signal to the light source 110. By this means, it is possible to ensure that the light emission time period of the light source 110 is in synchronization with the input time (e.g., timing) of the display data supplied from the controller 130 to the liquid crystal panel 200, thereby making it further possible to offer well-synchronized display.

As shown in FIG. 3, liquid crystal is controlled in such a manner that the panel transmission factor is set at a value of 10 in the first field. As a result of such liquid crystal control, the panel transmission factor has been "pre-raised" by that value at the very beginning (i.e., starting point in time) of the second field. Because the panel transmission factor has been pre-raised at the starting point in time of the second field, the actual panel transmission factor goes up to finally reach a value close to the maximum value of 255 as a result of the controlling of liquid crystal in such a manner that it (i.e., the panel transmission factor) is theoretically at the maximum value throughout the time period of the second field. The curve of the actual panel transmission factor is shown in FIG. 3, the rising/upward portion of which corresponds to the explanation given above. Therefore, the liquid crystal panel 200 transmits G light with excellent light-transmission performance, thereby making it possible to display images with higher brightness/luminance.

If the configuration of a driving circuit according to the present embodiment of the invention (a method for driving a display device according to the present embodiment of the invention) is adopted, the liquid crystal panel 200 "undesirably" transmits some amount of R light, though it is not so large, because the panel transmission factor is raised not only in the second field that corresponds to the G light emission time period but also in the first field that corresponds to the R light emission time period. Since the R light, which is not the transmission target G light (that is to be displayed) according to the specific example described herein, is also transmitted (i.e., also passes) through the liquid crystal panel 200, a color-mixture phenomenon occurs in a theoretical sense and in an exact sense. Despite the fact that a color-mixture phenomenon occurs in a theoretical sense and in an exact sense due to the transmission of the non-target R light through the liquid crystal panel 200, a user perceives almost no adverse effects of the mixture of R and G when viewed with the naked eye in actual and practical implementation of the invention. This is because the panel transmission factor for the target G light drastically improves as explained above. In addition, it is possible to reduce the adverse effects of the mixture of R and G if the conversion table 120*a* stored in the conversion unit 120 is prepared so as to effectively mitigate the adverse effects of the color-mixture phenomenon, which ensures further enhanced display performance.

Next, an example of liquid crystal control that is performed at the time of yellow (Y) display is explained below. Note that yellow (Y) is an intermediate color, that is, the color between R and G.

In the comparative-example graph of FIG. 5, it is assumed that intermediate yellow display is performed. That is, in a case where yellow Y, which is the intermediate color between R and G, is displayed, the panel transmission factor is set at a value of 255 in the R field, at a value of 255 in the G field, and at a value of 0 in the B field. That is, as indicated by a chain line in the comparative-example graph of FIG. 5, liquid crystal is controlled in such a manner that the panel transmission factor is theoretically at the maximum value throughout the time period of the R field during which R light is emitted and throughout the time period of the G field during which G light is emitted, a combination of which represents the intermediate color of Y.

However, as shown by a solid line in the comparative-example graph of FIG. 5, the actual panel transmission factor is nowhere near the maximum value of 255 during the R light emission time period even if liquid crystal is controlled in such a manner that the panel transmission factor is theoretically at the maximum value during the R light emission time period, although the panel transmission factor reaches values that are close to the maximum value during the G light emission time period. This is because, as has already been explained earlier, it takes some time for liquid crystal to respond. For this reason, the display brightness/luminance of the liquid crystal panel 200 is significantly decreased as in the foregoing assumption of the non-intermediate mono-green display. In addition to such a disadvantage, the reproduced (i.e., actually displayed) tone of color significantly deviates from the supposed one. That is, because of a large unbalance between the panel transmission factor in the R field and the panel transmission factor in the G field, the reproduced intermediate color (e.g., color tone) of Y is rather greenish; that is, it contains greater amount of the green color component and lesser amount of the red color component, resulting in poor display performance.

FIG. 6 shows an example of liquid crystal control that is performed at the time of yellow display according to an exemplary embodiment of the invention. In a method for driving a display device according to an exemplary embodiment of the invention, the panel transmission factor for each field is set as follows: the panel transmission factor for the first field is set at a value of 255; the panel transmission factor for the second field is set at a value of 210; the panel transmission factor for the third field is set at a value of 70. If the configuration of a driving circuit according to the present embodiment of the invention (a method for driving a display device according to the present embodiment of the invention) is adopted, which sets the panel transmission factors of the first, second, and third fields for yellow display at 255, 210, and 70, respectively, the panel transmission factor reaches values that are close to the maximum value of 255 during the R light emission time period as shown by a solid line. The reason why the panel transmission factor reaches values close to the maximum value of 255 during the R light emission time period in the driving method (driving circuit) according to the present embodiment of the invention shown in FIG. 6 unlike the comparative-example graph of FIG. 5 is that the panel transmission factor of the third field is set at a value of 70 in place of 0. Note that the third field is a field that is immediately before the first field. That is, in the driving method (driving circuit) according to the present embodiment of the invention, liquid crystal is held at a level that is responsive to a certain degree in the third field that precedes the first field so as to improve the panel transmission factor during the R light emission time period. In the subsequent second field, which follows the first field, the panel transmission factor is set at a value of 210. By this means, liquid crystal is controlled in such a manner that the value (e.g., percentage or ratio, though not limited thereto) of the R-light panel transmission factor approximates that of the G-light panel transmission factor. As a result thereof, the reproduced color tone of yellow is close to true yellow Y.

If the configuration of a driving circuit according to the present embodiment of the invention (a method for driving a display device according to the present embodiment of the invention) is adopted, the liquid crystal panel 200 transmits some amount of B light, which does not contribute to yellow display at all. This is because the panel transmission factor is raised not only in the first and second fields that respectively correspond to the R and G light emission time periods but also in the third field that corresponds to the B light emission time period. Since the B light, which is not used for yellow display at all, also passes through the liquid crystal panel 200, a color-mixture phenomenon occurs in a theoretical sense and in an exact sense. Despite the fact that a color-mixture phenomenon occurs in a theoretical sense and in an exact sense due to the transmission of the non-contributing B light through the liquid crystal panel 200, a user perceives almost no adverse effects of the mixture thereof when viewed with the naked eye in actual and practical implementation of the invention. This is because the panel transmission factors for the R and G light are improved as explained above. Thus, the driving method (driving circuit) according to the present embodiment of the invention makes it possible to increase the brightness/luminance of images displayed on the liquid crystal panel 200. In addition thereto, the driving method (driving circuit) according to the present embodiment of the invention makes it further possible to achieve an adequate color balance when displaying any immediate color so as to represent the correct color tone thereof.

In the foregoing description of a driving method/circuit according to exemplary embodiments of the invention, it is assumed that liquid crystal control is performed with the supplying of display data at the end of each light emission time period. Notwithstanding the foregoing, however, the timing of display-data supply may be shifted from the end of each light emission time period. For example, in a case where display data is supplied through vertical-scan operation, points in time at which the display data is supplied differ/vary from one another depending on respective vertical positions on the liquid crystal panel 200. In the following description, a modified driving method/circuit according to an exemplary embodiment of the invention that takes a difference in positions on the liquid crystal panel 200 into consideration is explained, taking an example of liquid crystal control that is performed around the center of the liquid crystal panel 200 under the assumption of vertical-scan operation.

When display data is supplied through vertical-scan operation, scanning is performed from the top of the liquid crystal panel 200 toward the bottom thereof in a sequential manner. For this reason, the timing of display-data supply at a certain lower position on the liquid crystal panel 200 is later (in point in time) than the timing of display-data supply at a certain upper position on the liquid crystal panel 200. For example, display data is supplied at the end of each light emission time period at/for the uppermost region (e.g., line) of the liquid crystal panel 200 at which scanning is performed at the earliest point in time (refer to FIGS. 2, 3, 5, and 6). In contrast thereto, display data is supplied not at the end of each light emission time period but some time thereafter at/for the center region of the liquid crystal panel 200 at which scanning is performed at the later point in time.

In the comparative-example graph of FIG. 7, it is assumed that non-intermediate mono-green display is performed. That is, in the assumed case where a green (G) color component only is displayed, the panel transmission factor is set at a value of 0 in the R field, at a value of 255 in the G field, and at a value of 0 in the B field. In the illustrated example described herein, since display data is supplied at a delayed timing, that is, a certain later point in time, the response of liquid crystal is also delayed. In comparison with FIG. 2, a solid line that represents the actual values of the panel transmission factor shown in FIG. 7 is shifted to the right. If liquid crystal is controlled/operated under such condition, the actual panel transmission factor during the G light emission time period is very low, which means that the liquid crystal panel 200 fails to transmit G light with satisfactory light-transmission performance. Consequently, the brightness/luminance level of images displayed by the liquid crystal panel 200 is further lower than that of the comparative example shown in FIG. 2.

FIG. 8 shows an example of liquid crystal control that is performed at a certain center position on the liquid crystal panel 200 according to the present embodiment of the invention, which corresponds to the comparative example of FIG. 7. In the driving method/circuit of a display device according to the present embodiment of the invention, the panel transmission factor for each field is set as follows: the panel transmission factor for the first field is set at a value of 60; the panel transmission factor for the second field is set at a value of 255; the panel transmission factor for the third field is set at a value of 0. If the panel transmission factor for the first field is set at a value of 10 as explained in the foregoing exemplary embodiment of the invention shown in FIG. 3, the panel transmission factor during the G light emission time period will be undesirably low because the supply of display data is delayed in the specific exemplary condition described herein. In the driving method/circuit of a display device according to the present embodiment of the invention, the panel transmission factor of the first field is set at a value of 60 in place of 10. Accordingly, if the driving method/circuit of a display device according to the present embodiment of the invention is adopted, it is possible to heighten the panel transmission factor in an earlier/speedier manner therein. That is, different (sets of) conversion rules that depend on positions on the liquid crystal panel 200 are used in a driving method/circuit according to the present embodiment of the invention. The use of the different (sets of) conversion rules on the basis of different positions on the liquid crystal panel 200 makes it possible to ensure a sufficiently high panel transmission factor during the G light emission time period even in a case where the supply of display data is delayed. Therefore, the liquid crystal panel 200 transmits G light with excellent light-transmission performance, thereby making it possible to display images with higher brightness/luminance.

In the foregoing description of the position-based liquid crystal control (i.e., position-based driving method) that uses different (sets of) conversion rules dependent on positions (e.g., scan positions, though not limited thereto) on the liquid crystal panel 200, it is assumed that non-intermediate green display is performed. However, the technical scope of a driving method/circuit according to the present embodiment of the invention is not limited to such a specific example. For example, the same advantageous effects as those offered by a driving method/circuit according to the present embodiment of the invention described above can be obtained when it is applied to the display of any intermediate color such as Y explained above. Thus, the driving method/circuit according to the present embodiment of the invention makes it possible to increase the brightness/luminance of images displayed on the liquid crystal panel 200. In addition thereto, the driving method/circuit according to the present embodiment of the invention makes it further possible to achieve an adequate color balance when displaying any immediate color so as to represent the correct color tone thereof.

The advantageous effects of a driving method/circuit according to an exemplary embodiment of the invention are produced as a result of the setting of a plurality of fields such as the first, second, and third fields explained above, though not limited thereto, and further as a result of the conversion/supply of display data on a field-by-field basis. However, the minimum unit of a time period for sequential operation of a driving method/circuit according to an exemplary embodiment of the invention is not limited to the field explained above. For example, each of the fields may be sub-divided into shorter unit time periods so as to obtain greater advantages of an aspect of the invention. As a non-limiting modification example thereof, each of the fields may be split into a first sub field that does not overlap the corresponding light emission time period and a second sub field that overlaps the corresponding light emission time period. Display data is supplied for each sub-field, that is, on a subfield-by-subfield basis. By this means, it is possible to further enhance the brightness/luminance of images displayed on the liquid crystal panel 200. More specifically, display data is supplied to a plurality of pixel units (e.g., pixel portions, pixel regions, pixel areas, or pixels, though not limited thereto) of the liquid crystal panel 200 every other line in a concurrent manner (i.e., at the same time) in each first sub-field. On the other hand, the display data is supplied to the remaining pixel units of the liquid crystal panel 200 on a line-by-line basis in a non-concurrent manner in each second sub-field. In such a modified driving operation/configuration, the display data is supplied to the pixel units of the liquid crystal panel 200 on a plurality of rows in a concurrent manner, which requires shorter time for the supplying of the display data in comparison with a case where the display data is supplied to the pixel units of the liquid crystal panel 200 on a line-by-line basis in a non-concurrent manner. Therefore, it is possible to make the length of the time period of each second sub-field relatively long, which means that the length of the time period during which light is emitted/irradiated is made relatively long, thereby making it further possible to display images with higher brightness/luminance.

As explained above, the driving method/circuit according to the present embodiment of the invention makes it possible to increase the brightness/luminance of images displayed on the liquid crystal panel 200. In addition thereto, the driving method/circuit according to the present embodiment of the invention makes it further possible to achieve an adequate color balance, for example, when displaying any immediate color, so as to represent the correct color tone thereof.

Electro-Optical Device

Figure 9:
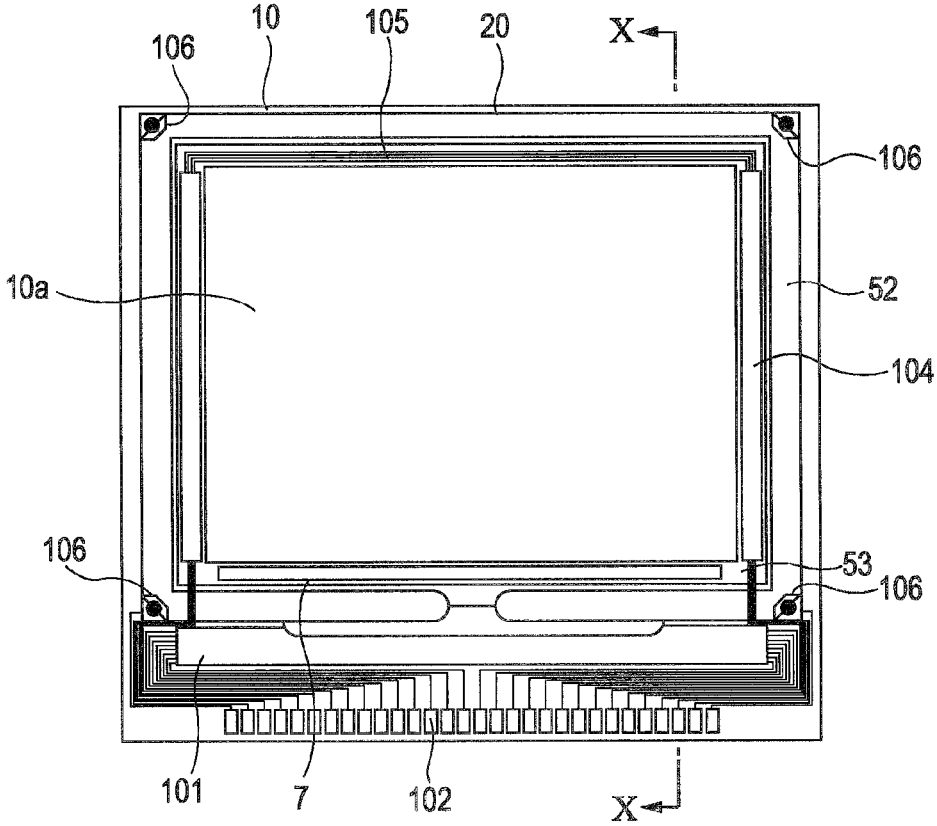
FIG. 9 is a plan view that schematically illustrates an example of the general configuration of a liquid crystal device according to an exemplary embodiment of the invention.
Figure 10:
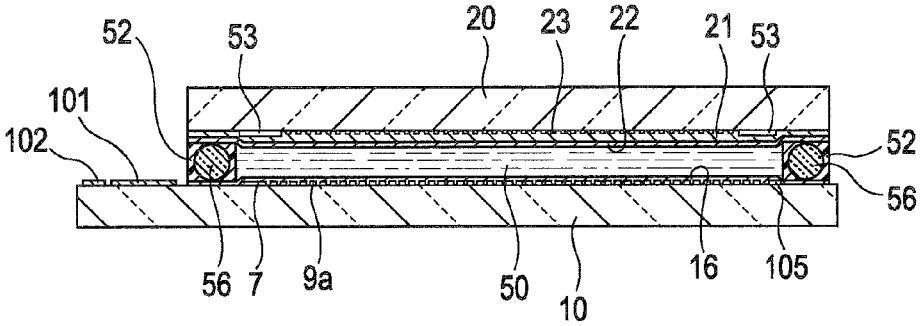
FIG. 10 is a sectional view taken along the line X-X of FIG. 9.

Next, with reference to FIGS. 9 and 10, an example of the configuration of an electro-optical device is explained below. A driving circuit according to an exemplary embodiment of the invention explained above can be applied to, or provided (e.g., built in) as a component circuit of, the electro-optical device described below. FIG. 9 is a plan view that schematically illustrates an example of the configuration of a liquid crystal device, which is an example of an electrophoresis display device according to the present embodiment of the invention. FIG. 10 is a sectional view taken along the line X-X of FIG. 9. In the following description of an exemplary embodiment of the invention, a liquid crystal device that conforms to a thin-film-transistor (TFT) active-matrix driving scheme is taken as an example of various kinds of electro-optical devices according to an aspect of the invention. It is assumed that the liquid crystal device explained in the following description is provided with a built-in driving circuit.

As shown in FIGS. 9 and 10, in the configuration of a liquid crystal device according to the present embodiment of the invention, a TFT array substrate 10 and a counter substrate 20 are arranged opposite to each other. The TFT array substrate 10 is configured as a transparent substrate that is made of, for example, a quartz substrate, a glass substrate, a silicon substrate, or the like. Likewise the TFT array substrate 10, the counter substrate (i.e., opposite substrate) 20 is also a transparent substrate. A liquid crystal layer 50 is sealed between the TFT array substrate 10 and the counter substrate 20. The TFT array substrate 10 and the counter substrate 20 are bonded to each other with the use of a sealant material 52 that is provided at a sealing region (i.e., sealing area) around an image display region (i.e., image display area) 10*a* where a plurality of pixel electrodes are provided.

The sealant material 52 is made from, for example, an ultraviolet (UV) curable resin, a thermosetting resin, or the like, which functions to paste these substrates together. In the production process of the liquid crystal device according to the present embodiment of the invention, the sealant material 52 is applied onto the TFT array substrate 10 and subsequently hardened through an ultraviolet irradiation treatment, a heat treatment, or any other appropriate treatment. A gap material such as glass fibers, glass beads, or the like, are scattered in the sealant material 52 so as to set the distance (i.e., inter-substrate gap) between the TFT array substrate 10 and the counter substrate 20 at a predetermined gap value.

Inside the sealing area at which the sealant material 52 is provided, and in parallel therewith, a picture frame light-shielding film 53, which has a light-shielding property and defines the picture frame region of the image display area 10*a*, is provided on the counter substrate 20. Notwithstanding the above, however, a part or a whole of the picture frame light-shielding film 53 may be provided at the TFT-array-substrate (10) side as a built-in light-shielding film.

A data line driving circuit 101 and external circuit connection terminals 102 are provided at a certain peripheral region outside the sealing region at which the sealant material 52 is provided in such a manner that these data line driving circuit 101 and external circuit connection terminals 102 are provided along one of four sides of the TFT array substrate 10. A pair of scanning line driving circuits 104 is provided along two of four sides thereof that are not in parallel with the above-mentioned one side in such a manner that each of the scanning line driving circuits 104 is enclosed by the picture frame light-shielding film 53. In addition to the above, a plurality of electric wirings 105 is provided along the remaining one side of the TFT array substrate 10 that is parallel with the first-mentioned one side thereof. The plurality of electric wirings 105 connects one of the pair of the scanning line driving circuits 104 to the other thereof. The picture frame light-shielding film 53 encloses these electric wirings 105. The pair of the scanning line driving circuits 104 is provided outside the image display region 10*a* in such a manner that each of these scanning line driving circuits 104 extends along the corresponding one of the second-mentioned two sides thereof.

Inter-substrate conductive terminals 106, which connect the TFT array substrate 10 with the counter substrate 20 by means of inter-substrate conductive material 107, are provided on the TFT array substrate 10 at positions corresponding to four corners of the counter substrate 20, respectively. With such a structure, it is possible to establish electric conduction between the TFT array substrate 10 and the counter substrate 20.

As illustrated in FIG. 10, a layered structure (i.e., lamination structure) that includes laminations of TFTs for pixel switching, which are driving/driver elements, and of wirings/lines such as scanning lines, data lines, and the like is formed on the TFT array substrate 10. Pixel electrodes 9*a* are formed at a layer above the lamination structure described above. An orientation film (i.e., alignment film) is deposited on the pixel electrodes 9*a*. Each of the pixel electrodes 9*a* is configured as a transparent electrode, which is made of a transparent (electro-) conductive material such as indium tin oxide (ITO) or the like. The alignment film (i.e., orientation film) is made of an organic film such as a polyimide film or the like. On the other hand, a light-shielding film 23 that has either a grid pattern or stripe pattern is formed on the counter substrate 20. A counter electrode 21 is formed on the entire surface of the light-shielded counter substrate 20. At the uppermost layer of a lamination structure formed on the counter substrate 20, an orientation film is formed. The counter electrode 21 is made of a transparent electro-conductive material such as indium tin oxide (ITO) or the like. The alignment film is made of an organic film such as a polyimide film or the like. The TFT array substrate 10 and the counter substrate 20 are adhered to each other so that the pixel electrodes 9*a* formed on the TFT array substrate 10 and the counter electrode 21 formed on the counter substrate 20 face (i.e., are provided opposite to) each other. In addition to other constituent elements described above, the liquid crystal layer 50 is formed between the TFT array substrate 10 and the counter substrate 20. The liquid crystal layer 50 is made of liquid crystal that consists of, for example, a mixture of one or more types of nematic liquid crystal element. Such liquid crystal takes a predetermined orientation state between a pair of the above orientation films (i.e., alignment films).

It should be noted that other functional circuits may also be provided on the TFT array substrate 10 illustrated in FIGS. 9 and 10 in addition to driving circuits such as the above-described data line driving circuit 101, the scanning line driving circuit 104, and the like, including but not limited to, a sampling circuit that performs the sampling of an image signal that flows on an image signal line so as to supply the sampled signal to a data line, a pre-charge circuit that supplies a pre-charge signal having a predetermined voltage level to each of the plurality of data lines prior to the supplying of an image signal, a test circuit for conducting an inspection on the quality, defects, etc., of the electro-optical device during the production process or before shipment, and the like.

Electronic Apparatus

Figure 11:
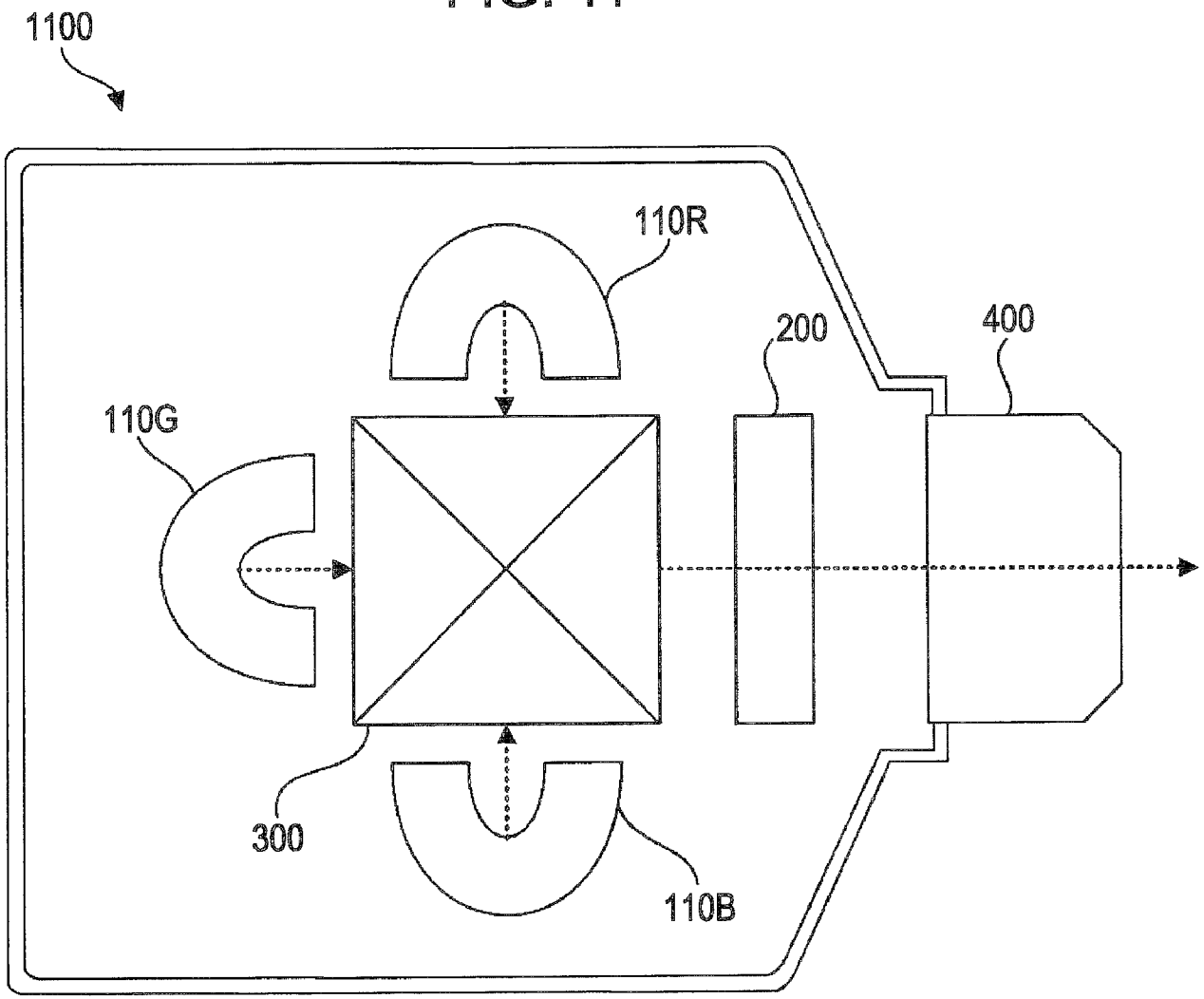
FIG. 11 is a plan view that schematically illustrates an example of the configuration of a projector, which is an example of electronic apparatuses to which an electro-optical device according to an aspect of the invention is applied.

Next, an explanation is given of an example of the applications of a liquid crystal device described above, which is a non-limiting example of an electro-optical device according to an aspect of the invention, to various kinds of electronic apparatuses. FIG. 11 is a plan view that schematically illustrates an example of the configuration of a projector. In the following description, an explanation is given of a projector that employs the above-described liquid crystal device as a light valve.

As illustrated in FIG. 11, a projector 1100 has a plurality of light-emitting diodes 110R, 110G, and 110B as its internal light-source elements. These LEDs 110R, 110G, and 110B correspond to three primary colors of R, G, and B, respectively. Each of the LEDs 110R, 110G, and 110B emits light of the corresponding primary color component in a frequency of, for example, 60 Hz so that light beams are emitted in a sequential manner. Each of red, green, and blue light emitted from the corresponding one of the LEDs 110R, 110G, and 110B enters a color-combination prism 300 as an incident light beam. As a result of combination thereof, a combined light beam is emitted from the color-combination prism 300 toward a liquid crystal panel 200, which is an example of a light valve.

The configuration of the liquid crystal panel 200 is the same as or similar/equivalent to that of a liquid crystal device explained above. An image signal processor (e.g., processing circuit) that is not shown in the drawing supplies a driving signal to the liquid crystal panel 200. A light beam that has been subjected to optical modulation at the liquid crystal panel 200 is outputted through a projection lens 400. In this way, a color image is projected on a projection target medium such as a projection screen or the like.

As explained above, the projector 1100, which is a non-limiting application example of an electro-optical device according to an aspect of the invention, is provided with the light-emitting diodes 110R, 110G, and 110B as its internal light-source elements that correspond to three primary colors of R, G, and B, respectively. With such a configuration, it is not necessary to provide any color filter therein. Since it is not necessary to provide any color filter therein, it is possible to achieve cost reduction. In addition thereto, it is possible to achieve high brightness because light does not pass through any color filter.

Among a variety of electronic apparatuses to which the electro-optical device according to an aspect the invention could be embodied are, in addition to the electronic apparatus (projector) explained above with reference to FIG. 11, a mobile-type personal computer, a mobile phone, a liquid crystal display television (i.e., liquid crystal television, LCD television), a viewfinder-type video recorder, a video recorder of a direct monitor view type, a car navigation device, a pager, an electronic personal organizer, an electronic calculator, a word processor, a workstation, a videophone, a POS terminal, a touch-panel device, and so forth. Needless to say, the invention is also applicable to these various electronic apparatuses without any limitation to those enumerated/mentioned above.

The present invention should be in no case interpreted to be limited to the specific embodiments described above. The invention may be modified, altered, changed, adapted, and/or improved within a range not departing from the gist and/or spirit of the invention apprehended by a person skilled in the art from explicit and implicit description given herein as well as recitation of appended claims. A method for driving a display device subjected to such modification, alteration, change, adaptation, and/or improvement, a circuit for driving (or a driving circuit of) a display device subjected thereto, an electro-optical device employing such a driving method or having such a driving circuit subjected thereto, and an electronic apparatus that is provided with such an electro-optical device, are also within the technical scope of the invention.

The entire disclosure of Japanese Patent Application No. 2007-246688, filed Sep. 25, 2007 is expressly incorporated by reference herein.

What is claimed is:

1. A method for driving a display device, comprising:

irradiating different colored light beams corresponding to source colors toward a display area during separate time periods, the different colored light beams corresponding to the source colors being different colors from each other and being irradiated independently from each other, the display area having a plurality of pixel units;

converting display data that is to be supplied to the plurality of pixel units, the conversion being performed on the basis of a predetermined conversion rule for each of a plurality of fields, the plurality of fields corresponding to respective light emission time periods of the plurality of light beams and following one after another in a successive manner on a time axis, the predetermined conversion rule converting data for a preceding field of one color to achieve a value in a successive field of a different color, such that the value approaches a desired value for at least one of brightness and color obtained when an image is displayed in the display area during the successive field, and a panel transmission factor of the data for a preceding field being increased due to the conversion; and supplying the converted display data to the plurality of pixel units in a sequential manner for each of the plurality of fields.

2. The method for driving a display device according to claim 1, further comprising:

setting the plurality of fields in such a manner that the plurality of fields correspond to the respective light emission time periods of the plurality of light beams and that the plurality of fields follow one after another in a successive manner on a time axis, wherein the above-mentioned conversion of the display data is performed so as to convert the display data for each of the plurality of set fields.

3. The method for driving a display device according to claim 1, further comprising:

setting the plurality of fields in accordance with the display data so as to achieve an actual value that is close to a desired value for at least either one of brightness and color obtained when an image is displayed in the display area, wherein the above-mentioned conversion of the display data is performed so as to convert the display data for each of the plurality of set fields.

4. The method for driving a display device according to claim 1, wherein the plurality of pixel units contains, without any limitation thereto, liquid crystal; and the plurality of fields is determined on the basis of the response time of the liquid crystal.

5. The method for driving a display device according to claim 1, wherein the plurality of pixel units contains, without any limitation thereto, liquid crystal; and the conversion rule is set on the basis of the response time of the liquid crystal.

6. The method for driving a display device according to claim 1, wherein the plurality of pixel units contains, without any limitation thereto, liquid crystal; and the liquid crystal is twisted nematic liquid crystal.

7. The method for driving a display device according to claim 1, wherein the plurality of fields is determined depending on the respective positions of the pixel units of the display area.

8. The method for driving a display device according to claim 1, wherein the conversion rules are set depending on the respective positions of the pixel units of the display area.

9. The method for driving a display device according to claim 1, wherein each of the light emission time periods of the plurality of light beams is shorter than the corresponding one of the plurality of fields.

10. The method for driving a display device according to claim 1, further comprising: temporarily storing the converted display data, wherein the above-mentioned supplying of the converted display data is performed in such a manner that the temporarily stored display data is read out and then supplied to the pixel units in a sequential manner.

11. The method for driving a display device according to claim 1, further comprising:

the different colored light beams being irradiated toward the display area during the separate time periods such that only one of the different colored light beams is irradiated during a corresponding one of the separate time periods.

12. The method for driving a display device according to claim 1, further comprising:

the predetermined conversion rule converting data for the preceding field of one color to achieve an increased value in the successive field of the different color.

13. A circuit for driving a display device, the driving circuit comprising:

a display area having a plurality of pixel units;

a light irradiating section that emits different colored light beams corresponding to source colors toward the display area during separate time periods, the different colored light beams corresponding to the source colors being different colors from each other and being irradiated independently from each other;

a data converting section that converts display data that is to be supplied to the plurality of pixel units, the data converting section converting on the basis of a predetermined conversion rule for each of a plurality of fields, the plurality of fields corresponding to respective light emission time periods of the plurality of light beams and following one after another in a successive manner on a time axis, the predetermined conversion rule converting data for a preceding field of one color to achieve a value in a successive field of a different color, such that the value approaches a desired value for at least one of brightness and color obtained when an image is displayed in the display area during the successive field, and a panel transmission factor of the data for a preceding field being increased due to the conversion; and a data supplying section that supplies the converted display data to the plurality of pixel units in a sequential manner for each of the plurality of fields.

14. An electro-optical device that is provided with the circuit for driving a display device according to claim 13.

15. An electronic apparatus that is provided with the electro-optical device according to claim 14.

16. The circuit for driving a display device according to claim 13, further comprising:

the different colored light beams being irradiated toward the display area during the separate time periods such that only one of the different colored light beams is irradiated during a corresponding one of the separate time periods.

17. The circuit for driving a display device according to claim 13, further comprising:

the predetermined conversion rule converting data for the preceding field of one color to achieve an increased value in the successive field of the different color.

* * * * *